United States Patent [19]

Thompson

[11] 4,031,800

[45] June 28, 1977

[54] KEYBOARD FOR A MUSICAL INSTRUMENT

[76] Inventor: Geary S. Thompson, 700 Schons Place, Wenatchee, Wash. 98801

[22] Filed: July 16, 1976

[21] Appl. No.: 705,789

[52] U.S. Cl. ..... 84/423; 84/451

[51] Int. Cl.[2] ..... G10C 3/12

[58] Field of Search ..... 84/423, 451

[56] References Cited

UNITED STATES PATENTS

| | | | |
|---|---|---|---|
| 1,685,401 | 9/1928 | Fellows | 84/451 |
| 1,795,468 | 3/1931 | Bonilla | 84/423 |
| 3,342,094 | 9/1967 | Wilson | 84/423 |
| 3,417,648 | 12/1968 | Honig | 84/423 |
| 3,468,209 | 9/1969 | Barreto | 84/423 |

*Primary Examiner*—Lawrence R. Franklin

*Attorney, Agent, or Firm*—Graybeal, Barnard & Uhlir

[57] ABSTRACT

Geometrically, my keyboard is characterized by a two-dimensional pattern of at least six horizontal and at least six vertical rows of keys. The center-to-center spacing between adjacent keys, both horizontally and vertically, is no greater than about one inch. Musically, the tones represented by the keys are arranged from left to right in ascending half-steps or in evenly spaced microtones and are stacked vertically in ascending perfect fourths. In preferred form, my keyboard comprises sixteen horizontal rows of keys and sixteen vertical rows of keys and possesses a tonal range that is slightly greater than the tonal range of a conventional piano.

8 Claims, 11 Drawing Figures

RANGE
FIVE LINE d
RANGE
SUB-CONTRA G#
10
12
14
14
26
20
22
24
14
18
etc.
TRANSPOSED FOR GUITAR
RANGE OF HORIZONTAL ROWS 5-10
RANGE OF HORIZONTAL ROWS 5-12

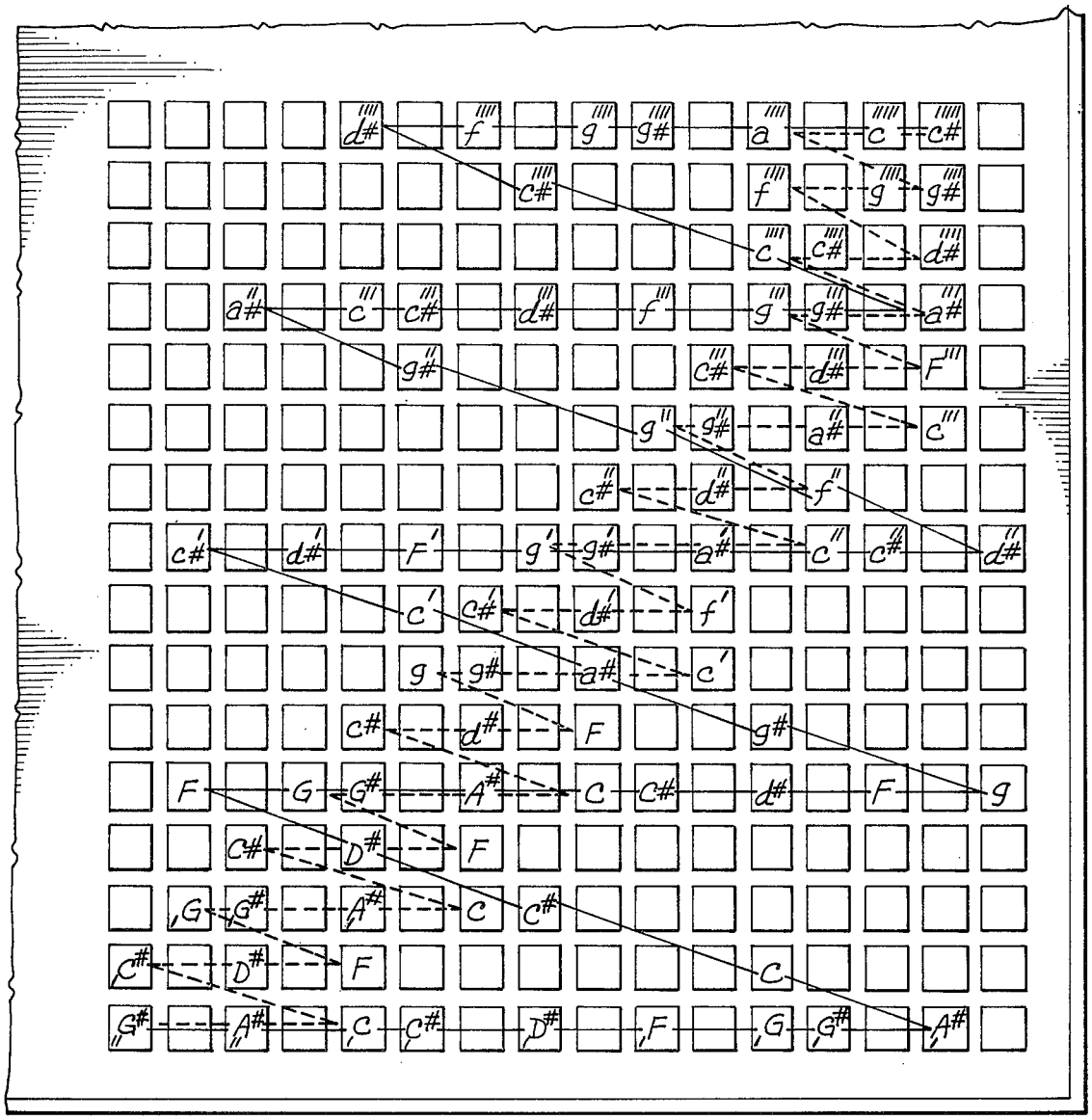
Fig. 2
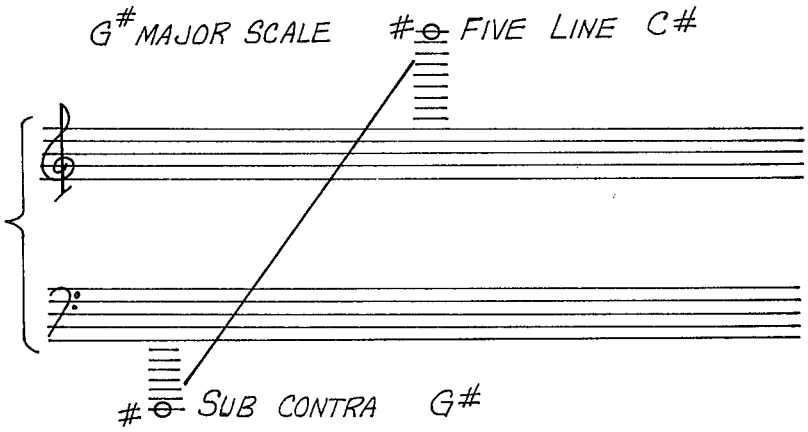

KEYBOARD FOR A MUSICAL INSTRUMENT

BACKGROUND OF THE INVENTION

1. Field of the Invention

My invention relates to geometric form and tone pattern aspects of a keyboard for a musical instrument, and to a new musical instrument employing my keyboard.

2. Description of the Prior Art

Conventional keyboards for instruments such as pianos, accordions, organs, and the like include a linear series or row or white and black keys representing a progression of tones arranged left to right in an ascending order. The white keys correspond to the natural diatonic scale. The black keys represent the accidentals or sharps and flats.

Several disadvantages of the conventional keyboard are discussed in U.S. Pat. No. 3,342,094, granted Sept. 19, 1967, to Ervin M. Wilson. This patent presents a keyboard which is composed of a plurality of vertically extending rows of vertically elongated push-button type keys. As discussed in the patent, the keyboard disclosed by the patent was designed to overcome several of the disadvantages of the conventional keyboard. The patentee states that he has provided a keyboard in which: (1) the pitch span of a single hand is vastly increased, so that octaves, tenths and the like are easily played by a musician even with physically small hands; (2) the position of the various keys of the keyboard is such that they will fall under the more natural physiological positions of a player's fingers when his fingers and hands are in a relaxed position; and (3) the placement and fingering on the keys is identical when transporting a tune from one tonic to a different tonic.

It is an object of my invention to overcome these same disadvantages of a conventional keyboard. My keyboard is also better adapted to the human hand and fingers and the placement of the fingers on the keys is identical when transposing a tune from one key to a different key. However, it is with these common objectives that any close similarity between my keyboard and the keyboard disclosed by U.S. Pat. No. 3,342,094 stops.

My keyboard is particularly well adapted for use with tone generating equipment of the type found in "synthesizers". However, the tone generating apparatus is not a part of my invention. For this reason, and also because the technology involved is both well developed and readily available I have omitted disclosing any particular type of tone generating equipment. Examples of readily available publications which disclose tone generators in considerable depth are: *Electronic Musical Instruments*, Third Edition, by Richard A. Dorf, Mahoney & Roese, Inc., 67 – 31316 (1968); and *The Electrical Reproduction of Music*, by Alan Douglas, Philosophical Library, J. Y. (1957).

The following additional patents, relating to keyboards for musical instruments (and some also disclosing tone generating equipment), should be consulted for the purpose of properly evaluating the subject invention and putting it into proper perspective: U.S. Pat. No. 2,250,522, granted July 29, 1941, to Saturnino T. Bonilla; U.S. Pat. No. 3,012,460, granted Dec. 12, 1961 to Ervin M. Wilson; U.S. Pat. No. 3,067,645, granted Dec. 11, 1962, to Mario Moschino; U.S. Pat. No. 3,417,648, granted Dec. 24, 1968 to Arnold Honig and U.S. Pat. No. 3,468,209, granted Sept. 23, 1969 to Clodovo G. G. Barreto.

SUMMARY OF THE INVENTION

My keyboard is basically characterized by a two-dimensional pattern of at least six horizontal rows of keys and at least six perpendicular vertical rows of keys. The tones represented by the keys are arranged horizontally from left to right in ascending half-steps or microtones and are stacked vertically in ascending perfect fourths. The center-to-center spacing of the keys, both horizontally and vertically, is no greater than about one inch.

My keyboard is more technically and musicaly facile than the standard piano keyboard. Wide intervals involve no stretching or awkward positioning of the hands. It has an expandible range, while offering compactness and symmetry. Its use makes music more readable, accessible and transposable. In preferred form, my keyboard is constructed to have a range of seven and one-half octaves and the tones are divided horizontally in half-steps. This range can be varied by merely adding or substracting vertical and/or horizontal rows of keys. The keyboard remains relatively compact even if expanded beyond the range of the human ear.

My keyboard presents a symmetrical grid pattern of advantageously sized and spaced keys. It facilitates uniform scale and chord patterns, transposition and improvisation. The scales and chords involve the same pattern from key to key. Transposition involves merely a symmetric shift of pattern, with identical fingering. The symmetrical grid pattern, by its nature, results in note duplication, making possible the playing of unisons and employment of alternate fingering.

My keyboard permits use of a ten finger technique in which either hand may function in any register. One hand can span from about three to about seven and one-half octaves, depending on the selected size of the key areas. Thus, two and three part counterpoint and four and five part harmony are one hand possibilities.

All standard piano and organ literature is playable on my keyboard. My keyboard, because of its grid pattern, permits the use of tablature, as employed in medieval guitar and lute literature. The grid pattern of my keyboard also permits the study of music as geometric patterns and makes possible the composition of music from geometric patterns, i.e. two dimensional diagrams.

Another important object of my invention is to provide a keyboard which has a direct relationship to a guitar or other stringed and fretted instrument that is turned to correspond to similarly adjacent horizontal rows of keys on the keyboard. The common note arrangement facilitates both cross-learning and a free exchange of musical ideas.

These and other features, objects and advantages of my keyboard, and of an electronic tone generator type musical instrument, or the like, utilizing such keyboard, will be apparent from the following detailed description of certain preferred embodiments of the invention.

BRIEF DESCRIPTION OF THE DRAWING

FIG. 2 is a view like FIG. 1, but including tone notations on only keys corresponding to two different key patterns of a single major scale, G sharp major;

DESCRIPTION OF THE PREFERRED EMBODIMENTS

Figure 1:
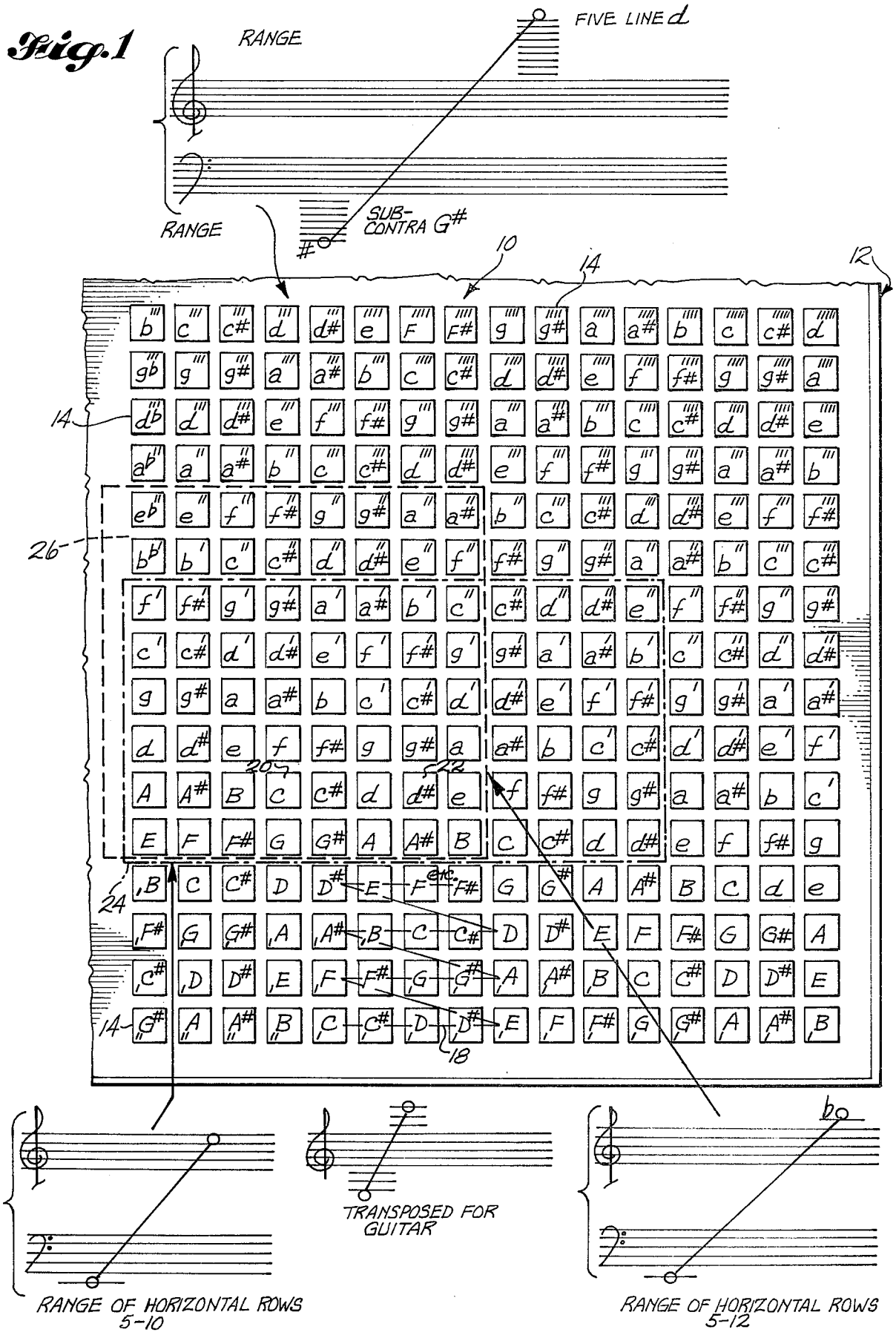
FIG. 1 is a fragmentary plan view of the keyboard portion of a musical instrument incorporating my invention, such view showing both a geometric arrangement of the keys into perpendicular horizontal and vertical rows, and the tone pattern of the keys, such view including the written range of the entire keyboard, the range of a portion of the keyboard corresponding to the fingerboard of a guitar tuned in fourths, and that section which approximates the required range of academic four-part writing.

As shown in FIG. 1, a keyboard 10 constructed in accordance with the present invention may occupy a corner portion of a musical instrument 12. Instrument 12 also includes apparatus for producing musical tones when the keys 14 (only some of which are referenced in the drawing) are touched and a suitable amplification system, neither one of which forms a part of the present invention.

The housing of instrument 12 may comprise a flat upper panel 16 having a plurality of holes formed therein through which the keys 14 project. Panel 16 may be horizontal or may slope downwardly towards the user.

The keyboard 10 is basically characterized by a plurality of horizontal and vertical rows of keys which are exactly perpendicular to each other. Each key 14 is centered within a square or rectangular area that measures no greater than about one inch along each side. Thus, the center-to-center spacing of the keys 14, both horizontally and vertically, is no greater than about one inch. In the illustrated embodiment the keys 14 are square and are constructed in a manner quite similar to the way that the push buttons of a push button type dial phone (i.e. a touch tone phone) are constructed. Of course, in other embodiments, the keys 14 may have a different shape, e.g. round. Keys 14 may be adapted to produce tones electronically by touch, light, heat sensitivity, etc. As previously explained, this aspect of the instrument 12 is not a part of the invention.

According to my invention, the tones represented by the keys 14 are arranged horizontally from left to right in either ascending half-steps or microtones. In preferred form the tones are arranged horizontally in half-steps, the smallest interval in Western music. Also according to my invention, the tones represented by the keys 14 are stacked vertically in ascending perfect fourths, the strongest interval in Western music.

The illustrated embodiment comprises sixteen horizontal rows of keys and sixteen vertical rows of keys. A subcontra G sharp tone is selected for the lower left corner key 14. This results in the upper right corner key representing a five-line *d* tone. In FIG. 1, the particular tone represented by each key 14 of the keyboard 10 is delineated on the key 14. FIG. 1 includes a grand staff positioned above the keyboard 10 which shows the full written range of the keyboard 10. This range extends from a half-step below the range of a standard eighty-eight key piano keyboard to a whole step above such piano keyboard. The logic of the grid arrangement of my keyboard is illustrated in the lower central portion of FIG. 1 by a chromatic scale 18 (commencing with the fifth horizontal key in the lowermost vertical row), which is compact, easy to see, and easily fingered with one hand.

Figures 3, 4:
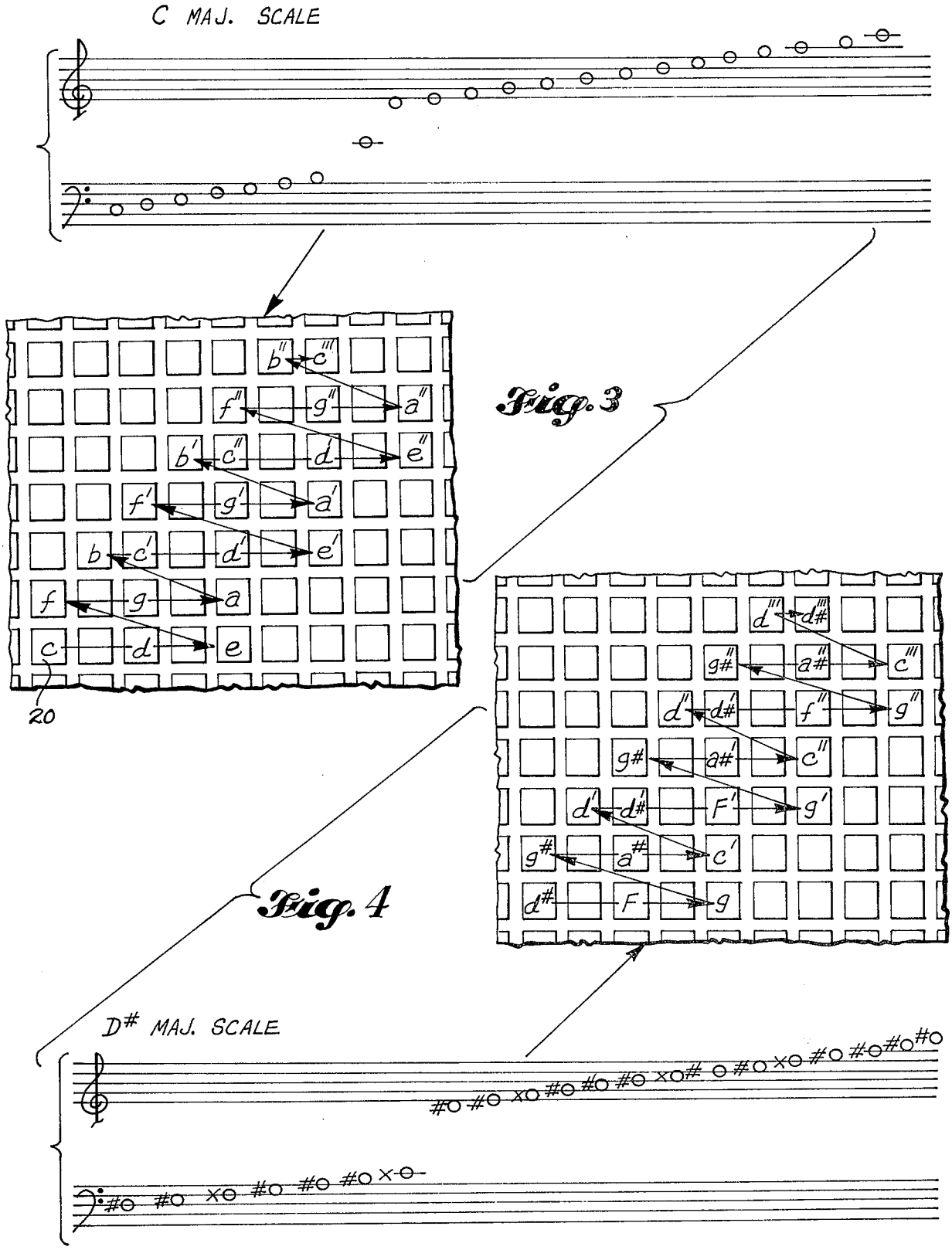
FIG. 3 is a fragmentary plan view of a portion of the keyboard, including tone notations on keys representing a one fingering pattern for a three octave C major scale, said view including the notation.
FIG. 4 is a view like FIG. 3, but of a portion of the keyboard representing the identical fingering pattern for a three octave D sharp major scale.
Figure 9:
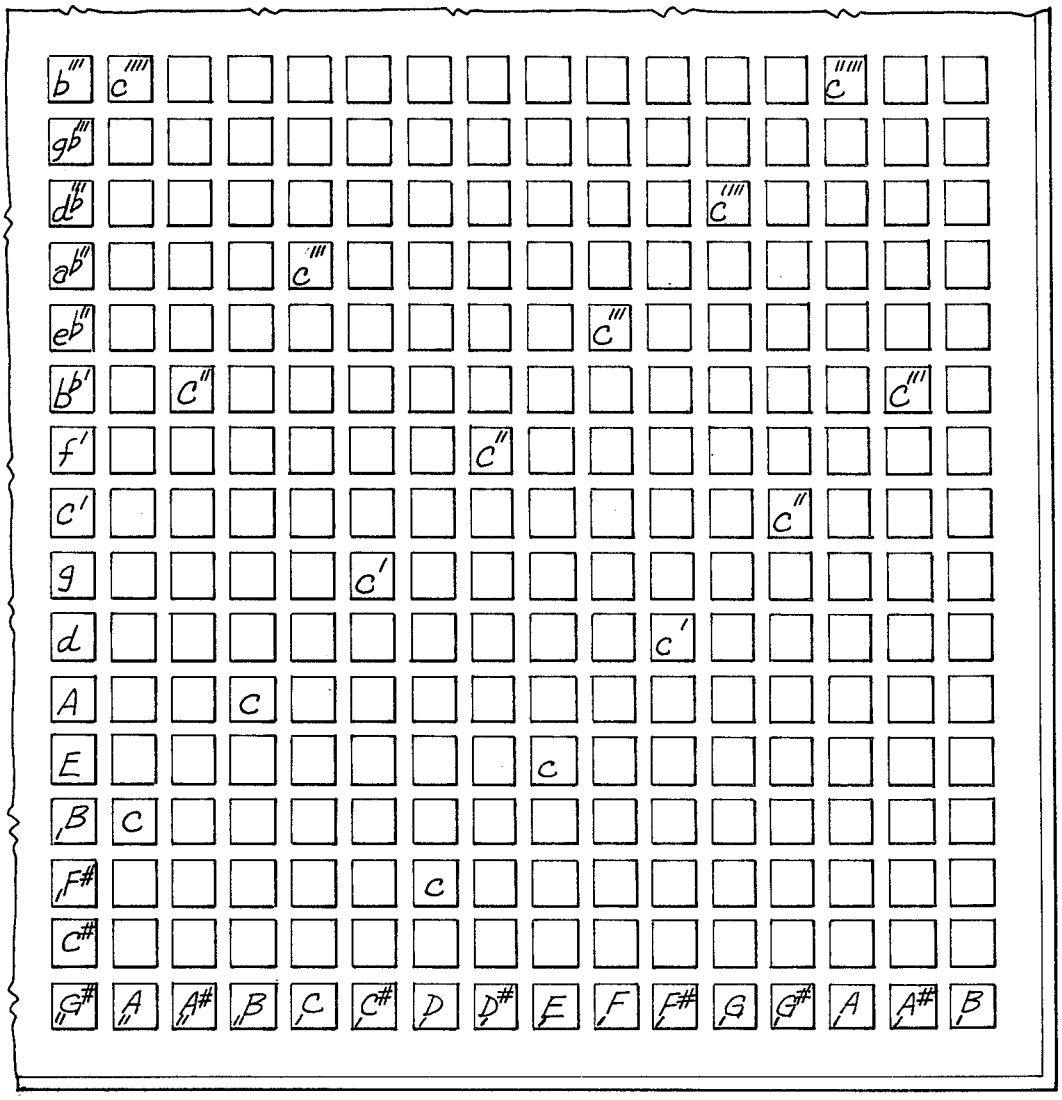
FIG. 9 is a view like FIG. 1, but with tone identification for only those keys corresponding to the note C and the other keys situated in the first vertical row and the bottom horizontal row, such view illustrating the symmetry of the keys corresponding to any given note.

The grid form of my keyboard both melody and harmony symmetric and geometric. Each note falls uniformly on vertical, horizontal and diagonal lines. This note pattern is shown by FIG. 9 in which the note C has been selected by way of example. Thus, melody and harmony form patterns on the keyboard and these patterns retain their quality (viz. major, minor, diminished - - - ) no matter where placed. Transporation involves only a simple equiparallel pattern shift, as is shown by FIGS. 3 and 4. Comparing FIG. 3 with FIG. 1, the note C at the lower end of the scale is designated 20 in each of these figures. The note *d* sharp at the lower end of the D sharp major scale shown by FIG. 4 is designated 22 in both FIG. 4 and FIG. 1. FIGS. 3 and 4 clearly illustrate identical scale patterns, differing only with respect to their position on the keyboard.

Figure 5:
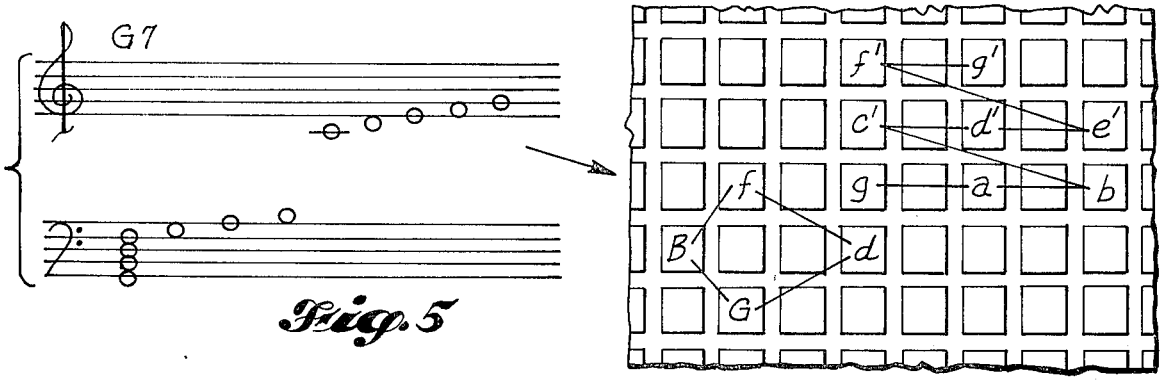
FIG. 5 is a view similar to FIGS. 3 and 4, but of the portion of the keyboard which includes the patterns for the $V_7$ or $G_7$ chord of the basic C blues progression and its related G mixolydian scale.
Figure 6:
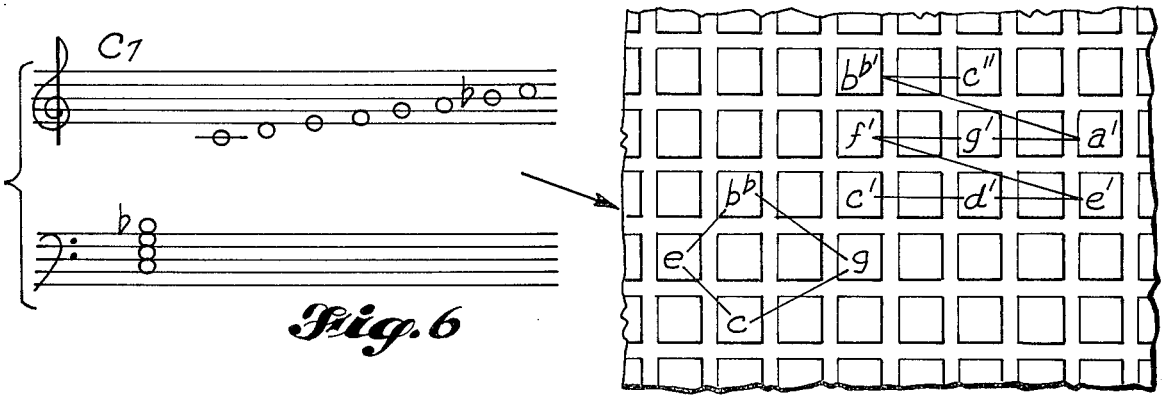
FIG. 6 is a view similar to FIGS. 3 and 4, but of the portion of the keyboard which includes the patterns for the $C_7$ chord and related scale.
Figure 7:
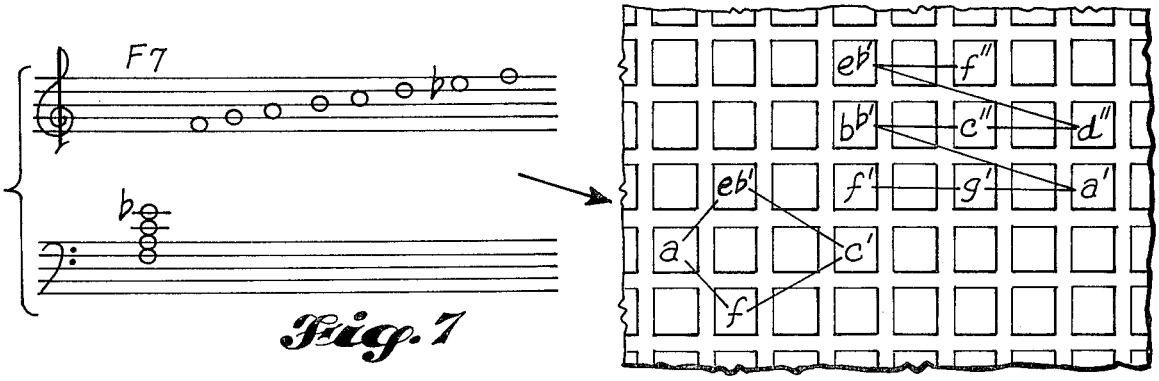
FIG. 7 is a view similar to FIGS. 3 and 4, but of the portion of the keyboard which includes the $F_7$ chord pattern and the pattern for its related mixolydian scale.
Figure 8:
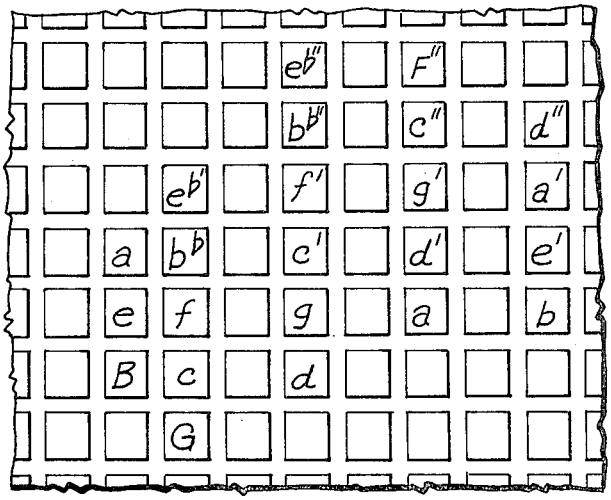
FIG. 8 is another fragmentary view of the keyboard showing the keys which are identified in FIGs. 5 – 7 superimposed in a single view.

Improvisation is aided by the fact that chord and scale patterns do not vary. By way of example, reference is made to FIGS. 5 – 8 which relate to the chord and scale patterns of basic blues music. FIGS. 5 – 7 illustrate that the primary chords and scale patterns of any key are vertically adjacent patterns. FIG. 8 shows the keys which are identified in FIGS. 5 – 7 together in a single view. This feature of constant chord and scale patterns makes possible the study of music as geometric patterns and the composition of music from geometric patterns, i.e., two dimensional diagrams.

Figure 10:
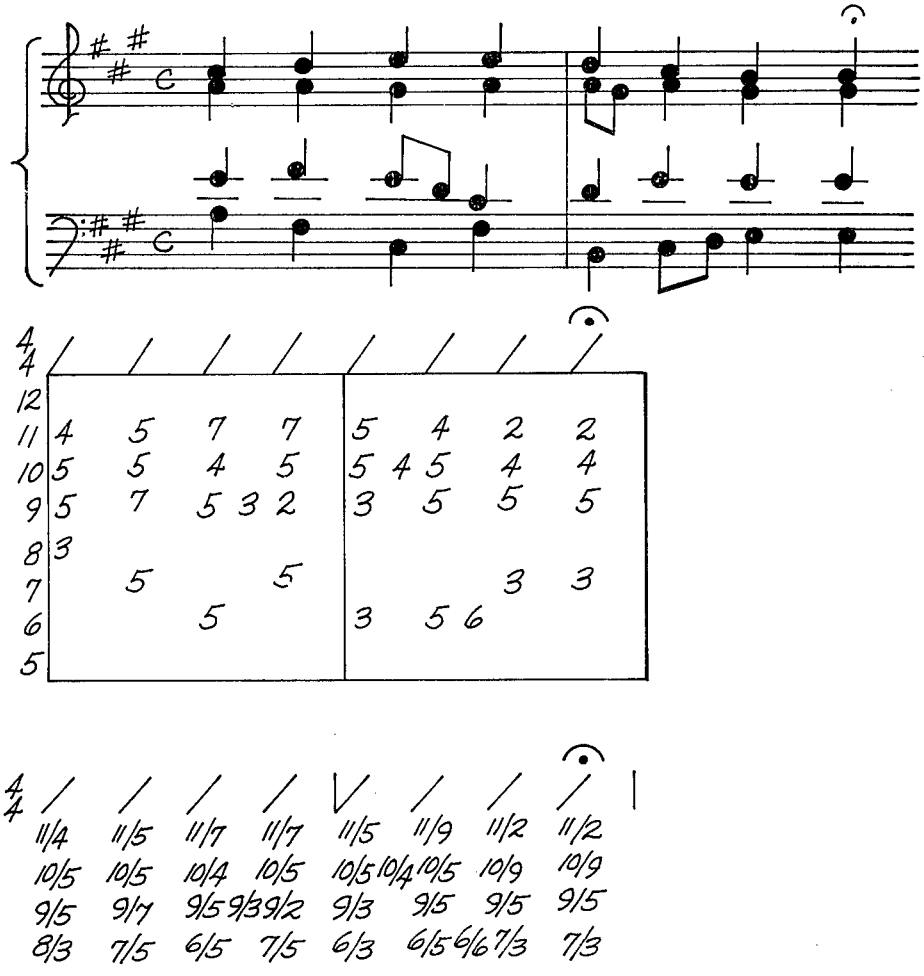
FIG. 10 illustrates three different ways of writing the same two measures of music for use in playing a musical instrument embodying my keyboard.

All standard piano and organ literature is readable and playable on my keyboard. Because of its grid pattern, my keyboard also permits the use of tablature, as employed in medieval guitar and lute literature. By way of example, FIG. 10 shows two measures of Bach Chorale No. 233, in standard staff and note form, and also two different ways of tablating the same music.

A ten-finger technique may be employed for playing my keyboard, with either hand functioning in any register. One hand can span from about three to about seven and one-half octaves or any five note harmonic figuration in between, depending on the size of the key areas. Two and three part counterpoint as well as four and five part harmony is playable with one hand. This makes it possible to play most beginning and intermediate piano literature single handed.

One very important advantage of my keyboard is that there is a note duplication which allows for unisons and alternate fingering. Unisons make possible colorings, as found in organ literature of voice and instrument arranging. By way of example, FIG. 2 illustrates two different patterns for the same scale, made possible by the note duplication. This allows for total right and left hand freedom.

Referring back to FIG. 1, a portion of the keyboard that corresponds to the strings of a guitar (or other stringed and fretted instrument having at least six strings) tuned in perfect fourths is designated 24. Thus, a musical instrument employing my keyboard, and including keys representing at least those tones included in the rectangular space 24, would share all scale and chord patterns with a stringed instrument which is tuned in fourths. This identity would make it easier for the student of one of these instruments to learn how to play the other. Also, music written for an instrument employing my keyboard can be played on a stringed and fretted instrument tuned in fourths, and vice versa. The electric fretted bass, being tuned in fourths, already corresponding to my keyboard. The mandolin is a logical additional instrument that could be tuned in fourths so that it would have a direct correspondence to an instrument employing my keyboard.

Referring again to FIG. 1, the portion of keyboard 10 contained within the area 26 encompasses the range requirements of soprano, alto, tenor and bass (SATB) writing. An electronic tone generator type musical instrument involving an eight key by eight key keyboard, corresponding to the tones represented within area 26 of FIG. 1, would meet the technical and musical demands of academic theory and at the same time would offer compactness and portability. A musical instrument of this character would enable a student to utilize existing piano pedagogy and its size would make it ideal for classroom teaching and use where conventional piano practice facilities are limited.

The range of my keyboard can be extended or contracted without creating any technical problems, merely by adding or subtracting horizontal and/or vertical rows of keys to or from the grid.

As stated above, a keyboard measuring 16 keys by 16 keys approximates the range of the piano, whereas a board measuring 32 keys by 32 keys would exceed the range of the human ear, but at the same time would be quite small and compact.

Figure 11:
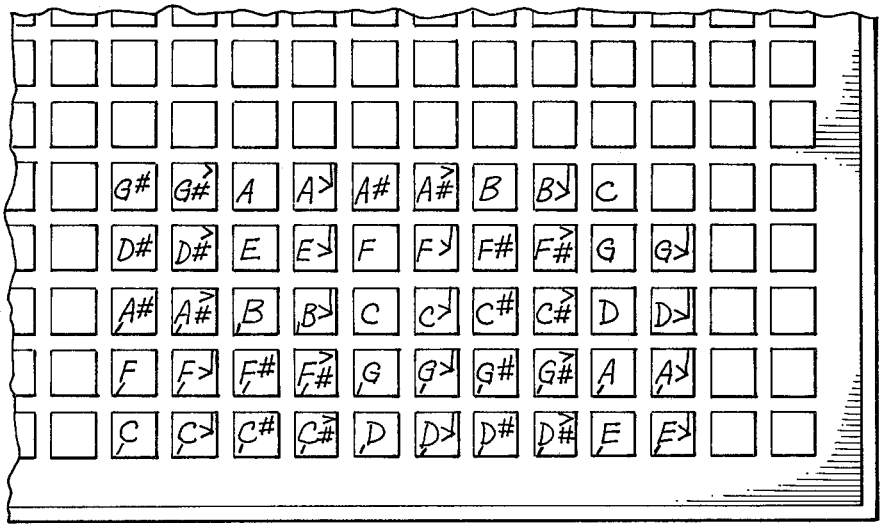
FIG. 11 is a view like FIG. 1, but of a keyboard with the tones represented by the keys being arranged horizontally from left to right in quarter steps, and stacked vertically in perfect fourths.

According to an aspect of the present invention, the pitch difference between horizontal keys can be subdivided so that the tones are arranged horizontally in evenly spaced microtones. A greater tone scale could easily be produced by adding a note between each horizontal note in the keyboard of FIG. 1. A portion of such a keyboard, and the smooth ten-finger quarter tone pattern that would be involved, is shown by FIG. 11.

What is claimed is:

1. A keyboard for a musical instrument of a type which includes means for producing musical tones when the keys are touched, wherein each key of the keyboard represents a particular tone, said keyboard comprising a two-dimensional pattern of at least six horizontal rows of keys and at least six perpendicular vertical rows of keys, wherein the tones represented by the keys are arranged horizontally from left to right in ascending half-steps and are stacked vertically in ascending perfect fourths, and wherein the cener-to-center spacing of the keys, both horizontally and vertically, is no greater than about one inch.

2. A keyboard according to claim 1, comprising keys representing tones susbstantially within the tonal range of a standard piano.

3. A keyboard according to claim 1, comprising 16 horizontal rows of keys and 16 vertical rows of keys, and wherein the lower left corner key represents a subcontra G sharp tone, and wherein the upper right corner key represents a five-line d tone.

4. A keyboard according to claim 1, comprising 6 horizontal rows of keys and 12 vertical rows of keys, representing tones corresponding to the tonal range of a six-stringed and fretted instrument tuned in fourths, so that the tones actuated by fingering said keys are identical to the tones produced by the same fingering patterns on a six-string stringed, fretted, instrument that is tuned in fourths.

5. A keyboard according to claim 4, wherein the lower left corner key of such six horizontal rows and twelve vertical rows group of keys represents an E tone and the upper right corner key of the group represents an *e''* tone.

6. A keyboard according to claim 1, comprising keys representing tones within the tonal range of academic four part writing, viz. soprano, alto, tenor and bass tones, wherein the lower left corner key of such group of keys represents an E tone and the upper right corner key of such group represents an *a* sharp tone.

7. A keyboard for a musical instrument of a type which includes means for producing musical tones when the keys are touched, wherein each key of the keyboard represents a particular tone, said keyboard comprising a two-dimensional pattern of horizontal and vertical rows of keys, wherein the tones represented by the keys are arranged horizontally from the left to right in even microtones and are stacked vertically in perfect fourths, wherein the center-to-center spacing of the keys, both horizontally and vertically, is not greater than about one inch; and wherein the keyboard includes at least enough keys so that the first key at the left end of a horizontal row will be the same note as a ket at the right end portion of the horizontal row below it.

8. A keyboard according to claim 7, comprising 11 horizontal rows of keys and 11 vertical rows of keys, and wherein the tones represented by the keys are arranged horizontally in quarter steps.

* * * * *

UNITED STATES PATENT OFFICE

CERTIFICATE OF CORRECTION

Patent No. 4,031,800 Dated June 28, 1977

Inventor(s) Geary S. Thompson

It is certified that error appears in the above-identified patent and that said Letters Patent are hereby corrected as shown below:

Column 1, line 13, "or", second occurrence, should be -- of --.

Column 1, lines 34, 35, "transporting" should be -- transposing --.

Column 2, line 13, "musicaly" should be -- musically --.

Column 2, line 52, "turned" should be -- tuned --.

Column 4, line 29, after "keyboard" insert -- makes --.

Column 4, line 36, "transporation" should be -- transposition --.

Column 5, line 6, after "possible" insert -- opposing --.

Column 5, line 7, "of" should be -- or --.

Column 5, line 26, "corresponding" should be -- corresponds --.

Column 5, line 55, "greater" should be -- quarter --.

Claim 6, column 6, line 40, "a sharp" should be -- a#'' --.

Claim 7, column 6, line 54, "ket" should be -- key --.

FIG. 1, fourth horizontal row from bottom, first vertical row from the right, "e" should be -- d --.

FIG. 1, fourth horizontal row from bottom, second vertical row from the right, "d" should be -- c# --.

FIG. 2, fifth horizontal row from top, second vertical row from the right, "F''' " should be -- f''' --.

FIG. 2, eighth horizontal row from top, sixth vertical row from the left, "F' " should be -- f' --.

FIG. 2, sixth horizontal row from bottom, ninth vertical row from left, "F" should be -- f --.

FIG. 2, fifth horizontal row from bottom, third vertical row from the right, "F" should be -- f --.

FIG. 3, third horizontal row from top of chart, third vertical row from right, "d' " should be -- d'' --.

FIG. 4, third horizontal row from top, fifth vertical row from the right, "d#' " should be -- d#'' --.

UNITED STATES PATENT OFFICE

CERTIFICATE OF CORRECTION

Patent No. 4,031,800 Dated June 28, 1977

Inventor(s) Geary S. Thompson

It is certified that error appears in the above-identified patent and that said Letters Patent are hereby corrected as shown below:

FIG. 4, bottom horizontal row, first vertical row from right, the numeral "22" should be added as a designator.

FIG. 4, third horizontal row from bottom, fifth vertical row from the right, "F' " should be -- f' --.

FIG. 4, bottom horizontal row, third vertical row from left, "F" should be -- f --.

FIG. 7, in the top staff, the note "b" (third line from bottom) should be a -- b flat tone --.

FIG. 7, in the chart, top horizontal row, fourth vertical row from the left, "$e_b$' " should be -- $e_b$'' --.

FIG. 8, top horizontal row, third vertical row from the right, "F'' " should be -- f'' --.

FIG. 8, second horizontal row from top, fifth vertical row from the right, "$b_b$'' " should be -- $b_b$' --.

FIG. 10, bottom chart, sixth vertical column, top horizontal row, "11/9" should be -- 11/4 --.

FIG. 10, bottom chart, seventh vertical column, second horizontal row, "10/9" should be -- 10/4 --.

FIG. 10, bottom chart, eighth vertical column, second horizontal row, "10/9" should be -- 10/4 --.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*